US012156538B2

(12) United States Patent
Leah et al.

(10) Patent No.: US 12,156,538 B2
(45) Date of Patent: Dec. 3, 2024

(54) AEROSOL PROVISION DEVICE CONFIGURED TO RECEIVE A PLURALITY OF AEROSOLIZABLE MATERIALS

(71) Applicant: NICOVENTURES TRADING LIMITED, London (GB)

(72) Inventors: Thomas David Leah, London (GB); Bryan Allbutt, London (GB); Lisa Harvey, London (GB)

(73) Assignee: NICOVENTURES TRADING LIMITED, London (GB)

( * ) Notice: Subject to any disclaimer, the term of this patent is extended or adjusted under 35 U.S.C. 154(b) by 788 days.

(21) Appl. No.: 17/250,031

(22) PCT Filed: May 8, 2019

(86) PCT No.: PCT/EP2019/061795

§ 371 (c)(1),
(2) Date: Nov. 9, 2020

(87) PCT Pub. No.: WO2019/215213

PCT Pub. Date: Nov. 14, 2019

(65) Prior Publication Data

US 2021/0227892 A1 Jul. 29, 2021

(30) Foreign Application Priority Data

May 8, 2018 (GB) ..... 1807497

(51) Int. Cl.
*A24F 40/30* (2020.01)
*A24F 40/42* (2020.01)
(Continued)

(52) U.S. Cl.
CPC ..... *A24F 40/30* (2020.01); *A24F 40/42* (2020.01); *A24F 40/53* (2020.01); *A24F 40/60* (2020.01);
(Continued)

(58) Field of Classification Search
CPC ..... A24F 40/10; A24F 40/20; A24F 40/30; A24F 40/42; A24F 40/53; A24F 40/60; A24F 40/65
(Continued)

(56) References Cited

U.S. PATENT DOCUMENTS 9,597,466 B2 * 3/2017 Henry, Jr. ..... A61M 11/042
9,763,478 B2 * 9/2017 Cameron ..... H04M 1/72415
(Continued)

FOREIGN PATENT DOCUMENTS

AU 2019267017 B2 12/2021
CA 3030101 A1 * 2/2018 ..... A24B 15/167
(Continued)

OTHER PUBLICATIONS

International Search Report and Written Opinion, Application No. PCT/EP2019/061795, mailed Aug. 5, 2019, 14 pages.
(Continued)

*Primary Examiner* — Peter G Leigh
(74) *Attorney, Agent, or Firm* — Burr & Forman LLP

(57) ABSTRACT

An aerosol provision device is configured to receive a plurality of aerosolizable materials. The aerosol provision device is configured to recognize an identity and a position of the aerosolizable materials received in the device and transmit data indicating the identity and the position of the aerosolizable materials received in the device to a communication system.

23 Claims, 6 Drawing Sheets

(51) Int. Cl.

| | |
|---|---|
| ***A24F 40/53*** | (2020.01) |
| ***A24F 40/60*** | (2020.01) |
| ***A24F 40/65*** | (2020.01) |
| *A24F 40/10* | (2020.01) |
| *A24F 40/20* | (2020.01) |

(52) U.S. Cl.
CPC ..... *A24F 40/65* (2020.01); *A24F 40/10* (2020.01); *A24F 40/20* (2020.01)

(58) Field of Classification Search
USPC ..... 131/329
See application file for complete search history.

(56) References Cited

U.S. PATENT DOCUMENTS

| | | | | |
|---|---|---|---|---|
| 9,770,055 | B2 * | 9/2017 | Cameron | A24F 40/30 |
| 9,864,947 | B1 * | 1/2018 | Sur | A24F 40/65 |
| 9,888,723 | B2 * | 2/2018 | Cameron | A24F 40/46 |
| 2013/0192618 | A1 * | 8/2013 | Li | A24F 40/44 131/329 |
| 2013/0340775 | A1 | 12/2013 | Juster | |
| 2014/0202477 | A1 | 7/2014 | Qi | |
| 2016/0325055 | A1 * | 11/2016 | Cameron | A24F 40/50 |
| 2016/0331023 | A1 * | 11/2016 | Cameron | A61M 11/041 |
| 2016/0331024 | A1 * | 11/2016 | Cameron | A24F 40/50 |
| 2016/0331034 | A1 * | 11/2016 | Cameron | A61M 15/0003 |
| 2016/0331036 | A1 * | 11/2016 | Cameron | H04Q 9/00 |
| 2016/0337362 | A1 * | 11/2016 | Cameron | G06Q 20/3278 |
| 2016/0338407 | A1 | 11/2016 | Kerdemelidis | |
| 2017/0014582 | A1 * | 1/2017 | Skoda | A24F 40/42 |
| 2017/0018000 | A1 | 1/2017 | Cameron | |
| 2017/0020191 | A1 * | 1/2017 | Lamb | A24F 40/40 |
| 2017/0093960 | A1 | 3/2017 | Cameron | |
| 2017/0258138 | A1 | 9/2017 | Rostami | |
| 2018/0220711 | A1 * | 8/2018 | Suzuki | A24F 40/65 |

FOREIGN PATENT DOCUMENTS

| | | | | | |
|---|---|---|---|---|---|
| CN | 106037021 | A | | 10/2016 | |
| CN | 106254523 | A | | 12/2016 | |
| CN | 106793835 | A | | 5/2017 | |
| CN | 107205484 | A | * | 9/2017 | A24F 40/51 |
| EP | 3098738 | A1 | * | 11/2016 | A24F 40/53 |
| EP | 2903465 | B1 | * | 3/2018 | A24F 40/53 |
| KR | 1020180044410 | A | | 5/2018 | |
| RU | 2618436 | C2 | | 5/2017 | |
| RU | 176917 | U1 | | 2/2018 | |
| WO | 2014195805 | A2 | | 12/2014 | |
| WO | WO2015179002 | A2 | | 11/2015 | |
| WO | WO-2017019428 | A1 | * | 2/2017 | A24B 15/167 |
| WO | WO2017056103 | A1 | | 4/2017 | |
| WO | WO-2017057286 | A1 | * | 4/2017 | A24F 40/50 |
| WO | 2017140898 | A1 | | 8/2017 | |
| WO | 2018025217 | A1 | | 2/2018 | |

OTHER PUBLICATIONS

"International Preliminary Report on Patentability received for PCT Patent Application No. PCT/EP2019/061795, mailed on Nov. 19, 2020", 8 pages.

"Office action received for Chinese Patent Application No. 2019800310117, mailed on Mar. 1, 2023", 12 pages (9 pages of English Translation and 3 pages of Official Search Report Only).

"Office Action received for Russian Patent Application No. 2020136210, mailed on Mar. 31, 2020", 3 pages.

Preliminary Rejection from Corresponding Korean Application No. 10-2020-7032238 mailed Dec. 20, 2023, all pages cited in its entirety.

* cited by examiner

AEROSOL PROVISION DEVICE CONFIGURED TO RECEIVE A PLURALITY OF AEROSOLIZABLE MATERIALS

PRIORITY CLAIM

The present application is a National Phase entry of PCT Application No. PCT/EP2019/061795, filed May 8, 2019, which claims priority from GB Patent Application No. 1807497.1, filed May 8, 2018, each of which is hereby fully incorporated herein by reference.

TECHNICAL FIELD

The present disclosure relates to an aerosol provision device and to a method of communicating data between the aerosol provision device and a communication system, such as a smart device.

BACKGROUND

Smoking articles such as cigarettes, cigars and the like burn tobacco during use to create tobacco smoke.

Attempts have been made to provide alternatives to these articles that burn tobacco by creating products that release compounds without burning.

Examples of such products are heating devices which release compounds by heating, but not burning, the material. The material may be for example tobacco or other non-tobacco products, which may or may not contain nicotine.

As another example, there are so-called e-cigarette devices. These devices typically contain a liquid which is heated to vaporize the liquid to produce an inhalable vapor or aerosol. The liquid may contain nicotine and/or flavorings and/or aerosol-generating substances, such as glycerol. The known e-cigarette devices typically do not contain or use tobacco.

It is desirable to provide the user of electronic aerosol-generating devices, such as those mentioned above, with ways of enhancing their usage experience. In order to do this, in some known examples an aerosol-generating device may interact with a smart device and the smart device may gather usage statistics relating to the aerosol provision device. The gathered information can be used to enhance the user's experience by, for example, allowing a user to see the length of time and frequency with which they have used the device, or allowing a user to place an order for more e-liquid when a sensor indicates that the e-liquid is close to being depleted.

SUMMARY

According to a first aspect of the present disclosure, there is provided an aerosol provision device which is configured to receive a plurality of aerosolizable materials, wherein the aerosol provision device is configured to recognize an identity and a position of the aerosolizable materials received in the device and transmit data indicating the identity and the position of the aerosolizable materials received in the device to a communication system.

The aerosolizable material may be a material for producing an aerosol or altering a property of an aerosol.

The communication system may comprise a smart device. The communication system may comprise at least one internet-based server and the smart device may be configured to communicate data transmitted from the aerosol provision device to the internet-based server. The communication system may be configured to display to a user a representation of a configuration of the aerosol provision device, wherein the representation comprises a representation of the identity and position of each aerosolizable material received in the device. The communication system may be configured to display to a user a representation of a current or completed usage session of the aerosol provision device.

The communication system may be configured to gather one or more types of data relating to the usage of the aerosol provision device in addition to the identity and the position of aerosolizable materials received in the device, wherein the one or more types of data relate to one or more of: the duration of a usage session, the identity of each aerosolizable material used during a usage session, the amount of each aerosolizable material used during a usage session, the rate at which each aerosolizable material is used during a usage session, the amount of each aerosolizable material remaining after a usage session, or the order in which the aerosolizable materials were used during a usage session.

The communication system may be configured to provide a pre-defined usage session to a user, wherein the usage session is at least in part defined by one or more of: the duration of a usage session, the identity of each aerosolizable material used during a usage session, the amount of each aerosolizable material used during a usage session, the rate at which each aerosolizable material is used during a usage session, the amount of each aerosolizable material remaining after a usage session, or the order in which the aerosolizable materials were used during a usage session. The pre-defined usage session may be a recommended usage session or a past usage session of the user for which defining data has been gathered by the communication system from the aerosol provision device.

A factor defining a pre-defined usage session which is provided to the user may be dependent on the identity of aerosolizable materials recognized as being received in the aerosol provision device at the time that the pre-defined usage session is provided to the user. A factor defining a usage session which is provided to the user may be dependent on information gathered by the communication system in addition to the identity and position of aerosolizable materials received in the device, such as a preference of the user, a location of a user, a time of day, or whether the user is indoors or outdoors.

A user may be able to create a usage session via the communication system wherein the usage session is defined by one or more of: the duration of the usage session, the identity of each aerosolizable material used during the usage session, the amount of each aerosolizable material used during the usage session, the rate at which each aerosolizable material is used during the usage session, the amount of each material remaining after the usage session, or the order in which the aerosolizable materials are used during the usage session.

The communication system may be configured to control the aerosol provision device. The communication system may be configured to implement a user created usage session or a pre-defined usage session.

The aerosol provision device may be configured to receive a first aerosolizable material, a second aerosolizable material and at least one further aerosolizable material, wherein the first aerosolizable material comprises an aerosolizable material and the second aerosolizable material comprises a first flavorant material and the at least one further aerosolizable material comprises a second flavorant material. The aerosol provision device may comprise a plurality of slots where each slot is for receiving one aerosolizable material.

Each aerosolizable material may be provided in a container, wherein each container comprises an RFID tag and the aerosol provision device comprises at least one RFID tag reader. Each aerosolizable material may be provided in a container, wherein at least one of the containers comprises an atomizer for aerosolizing material contained by the container. The aerosol provision device may comprise means for aerosolizing the aerosolizable material.

According to a second aspect of the disclosure there is provided a system comprising an aerosol provision device according to the first aspect and a communication system.

According to a third aspect of the disclosure there is provided a method of use of a system according to the second aspect, wherein the method comprises the aerosol provision device transmitting data indicating the identity and position of aerosolizable materials received within the aerosol provision device to the communication system.

According to a fourth aspect of the disclosure there is provided a smart device configured to communicate with an aerosol provision device according to the first aspect, wherein the aerosol provision device is configured to transmit the identity and position in the aerosol provision device of aerosolizable material received in the aerosol provision device to the smart device.

According to a fifth aspect of the disclosure there is provided a set of instructions for a communication system, wherein the set of instructions comprises receiving data from an aerosol provision device according to the first aspect, and wherein the data indicates the identity and position of aerosolizable material received in the aerosol provision device.

According to a sixth aspect of the disclosure there is provided an aerosol provision device which is configured to receive a plurality of aerosolizable materials, wherein the aerosol provision device is configured to recognize an identity and a position of the aerosolizable materials received in the device and is configured to generate aerosol based on an instruction including the identity of one or more of the aerosolizable materials. The instruction may be based on the identity and position of the aerosolizable materials received by the aerosol provision device.

DETAILED DESCRIPTION

Figure 1:
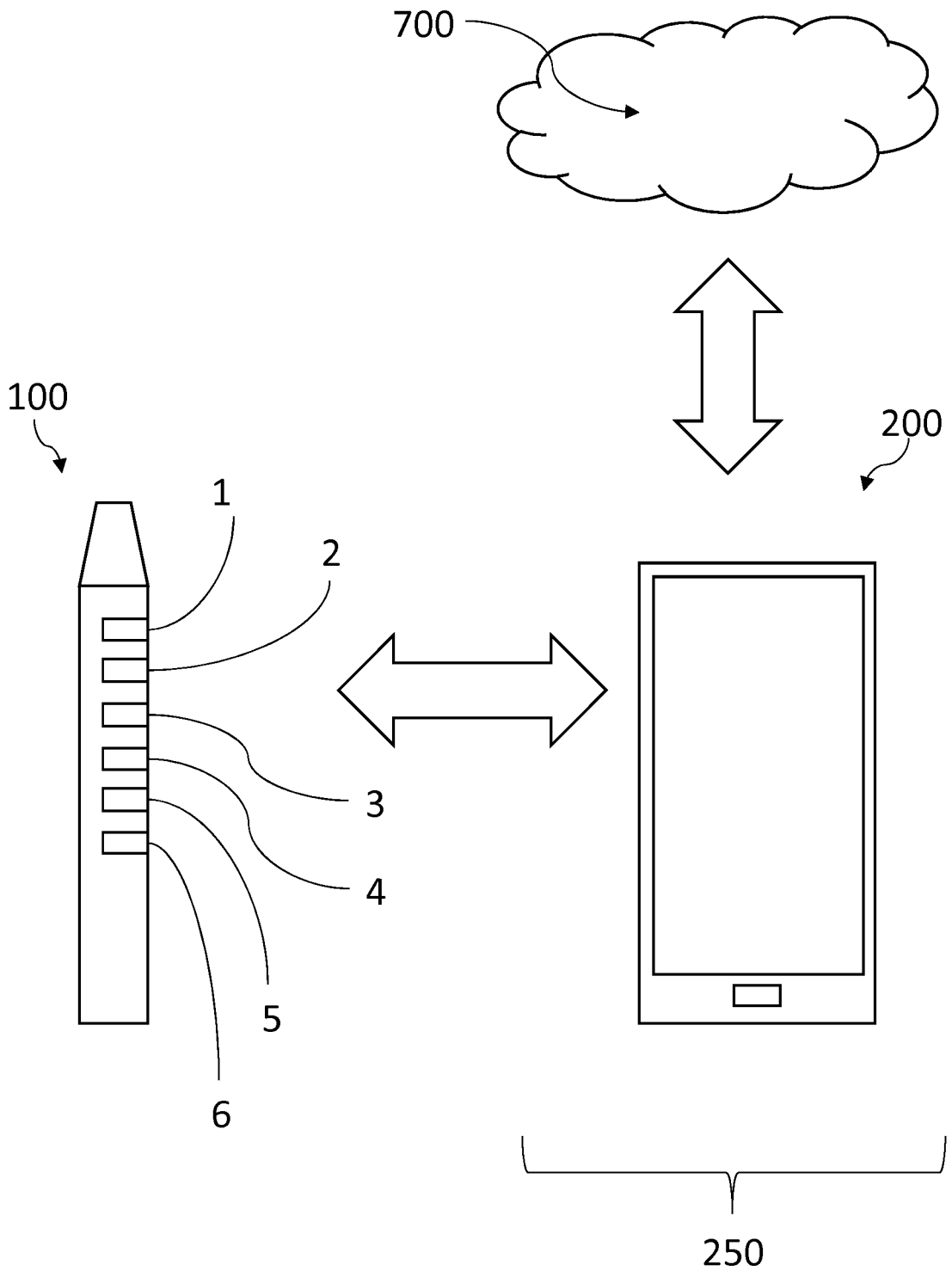
FIG. 1 shows a schematic representation of an example aerosol provision device in communication with a communication system.

Referring to FIG. 1, a schematic of a system comprising an aerosol provision device 100 and a communication system 250, is illustrated. The aerosol provision device 100 is an inhalation device (i.e. a user uses it to inhale an aerosol provided by the device 100) and the device 100 is a hand-held device. The device 100 is an electronic device. The aerosol provision device 100 is configured to communicate with a communication system 250, for example a communication system 250 comprising a smart device 200. The smart device 200 may, for example, be a mobile phone, tablet, laptop computer, television, or any other device capable of electronic communication. The communication system 250 may additionally or alternatively comprise the internet 700.

Figure 2:
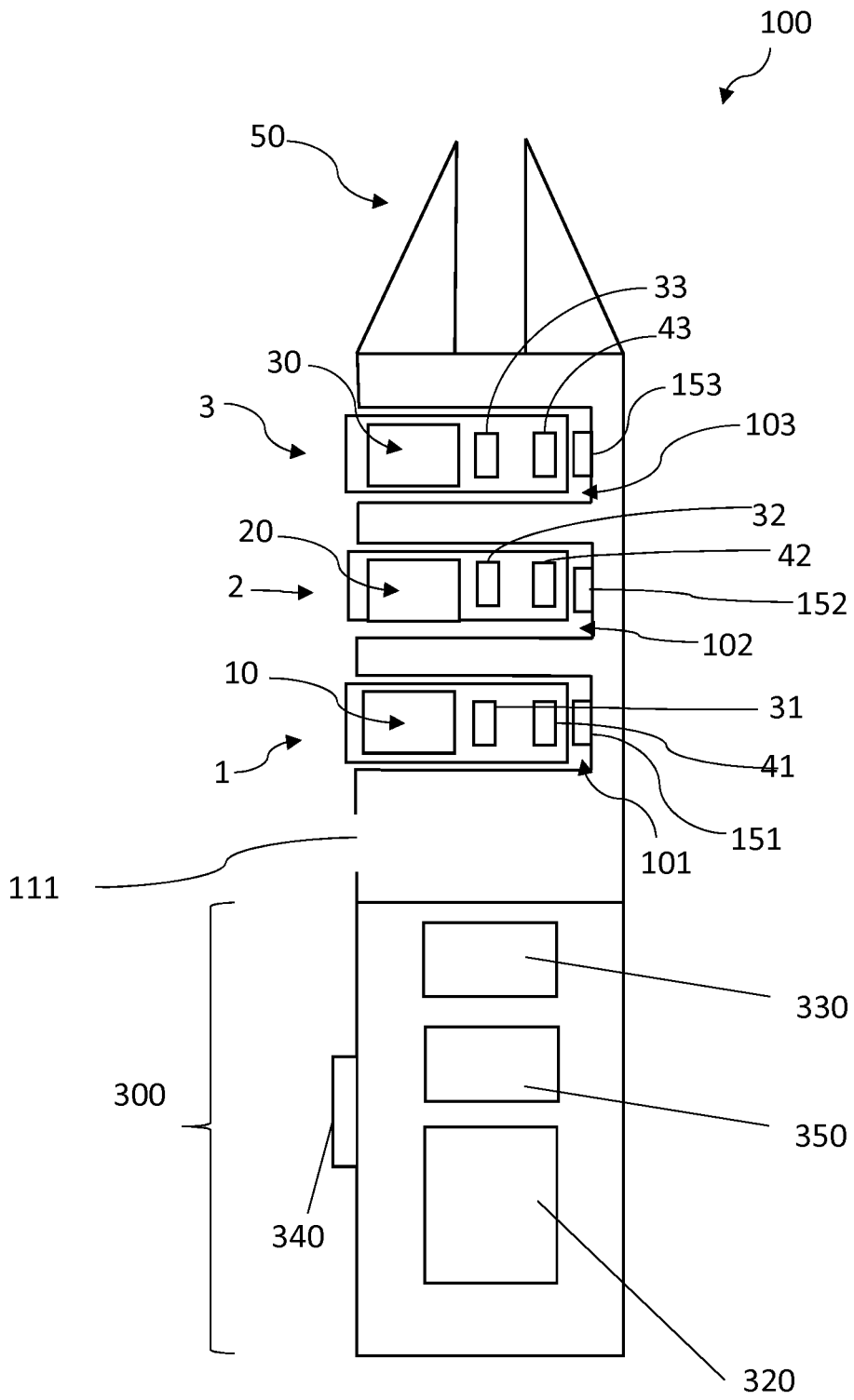
FIG. 2 shows a schematic representation of an example of an aerosol provision device for communicating with a communication system.

With reference to FIG. 1 and FIG. 2, in broad outline, the device 100 is configured to generate an aerosol for inhalation by a user from at least one aerosolizable material received within the device 100. Herein an aerosolizable material includes any material that may be aerosolized. In the examples discussed herein the aerosol provision device 100 is configured to receive a plurality of aerosolizable materials, where each aerosolizable material is housed in or forms a consumable, e.g., the consumable may be a container housing the aerosolizable material. The aerosol provision device 100 is configured to receive at least a first consumable 1 and a second consumable 2, and the device 100 may also be configured to receive further consumables 3, 4, 5 and 6. Herein, reference is made to the device 100 receiving consumables 1, 2, 3, 4, 5, 6; however, it should be appreciated that device 100 more generally receives a plurality of aerosolizable materials. In some implementations, the aerosolizable materials may be provided detached from one another (e.g., as separate consumables as described herein) or may be provided on a common substrate as a single consumable to be received in the device 100.

The aerosol provision device 100 is configured to recognize the identity and position of consumables 1, 2, 3, etc. received in the device 100 (as will be discussed in detail below) and to transmit data indicating the identity and position of consumables 1, 2, 3, etc. received in the device 100 to the communication system 250, in this example comprising smart device 200. In some examples, such as that of FIG. 1, the communication system 250 may comprise the internet 700 and in some examples the aerosol provision device 100 may communicate directly with the internet 700. In some examples the aerosol provision device 100 communicates with the smart device 200, which may or may not communicate data relating to the aerosol provision device 100 to the internet 700.

Among other advantages, the aerosol provision device 100 and communication system 250 allow for a usage session which is appropriate for the consumables 1, 2, 3, etc. received within the device 100 to be implemented, a usage session either being directly implemented by interaction between the user and the aerosol provision device 100 or being implemented, for example, through communication from the communication system 250, for example from the smart device 200. As will be discussed further below, the aerosol provision device 100 and communication system 250 also provide for appropriate settings to be applied to the aerosol provision device 100 depending on the consumables inserted and depending on the contextual environment of the user. Herein, reference is made to example devices transmitting data regarding the identity and position of consumables or, more generally, aerosolizable materials received in the device. It should be appreciated that in some implementations, a device may recognize the identity and/or position of consumables/materials received in the device and a controller or the like in the device may use the identity and position data to provide instructions to the device for producing an aerosol based on the identity and/or position of consumables/materials received in the device. Certain advantages described herein in the context of an aerosol provision device in communication with a communication system may thus be achieved by features of the aerosol provision device alone. For example, in some examples the device may not necessarily transmit position and identity data of consumables/materials received to an external system or device and appropriate instructions for generating aerosol may be produced by the device based on the position and/or identity of consumables/materials received in the device.

The device 100 comprises means for receiving at least the first consumable 1 for containing a first aerosolizable material 10, and for receiving the second consumable 2 for containing a second material 20. In some examples, discussed further below, the device is configured to receive further consumables, for example the device 100 may be configured to receive third 3, fourth 4, fifth 5, and sixth 6 consumables for containing third 30, fourth 40, fifth 50 and sixth 60 aerosolizable materials respectively. In other examples, the device 100 may be configured to receive any number, two or more, of consumables.

In use, a user draws on a mouthpiece 50 of the device and air is drawn through one or more air inlets 111 into the device 100. Aerosol is generated by the device 100 from at least the first consumable 1 containing first aerosolizable material 10. The one or more air inlets 111 and the first consumable 1 are in fluidic contact with a central aperture (not shown), and air flowing in through the one or more air inlets 111 mixes with aerosol generated from the first consumable 1 to generate a flow of aerosol. The aerosol flow is drawn towards the mouthpiece 50 for inhalation by the user when the user draws on the mouthpiece 50. In some examples, air flowing from the air inlets to the mouthpiece 50 may pass through each consumable or aerosolizable material received in the device sequentially. That is, each of the consumables or aerosolizable materials in the device may be located on the same air flow path between the air inlets and the mouthpiece. In other examples, there may be multiple branches for air flowing from the air inlet/s towards the mouthpiece. For example, a plurality of branches may be provided and each branch of the plurality of branches may pass through one or more of the consumables or aerosolizable materials. There may be one branch for each of the consumables or aerosolizable materials, or each air flow path may pass through more than one of the consumables or aerosolizable materials. In some examples, where there are multiple air flow branches there may be a branch which does not pass through a consumable or aerosolizable material. Where there are multiple air flow branches the branches may join, in an admixing chamber or the like, prior to aerosol flowing to the mouthpiece.

The second consumable 2 may also produce aerosol which mixes with the aerosol generated from the first consumable 1 before the aerosol reaches the mouthpiece 50 for inhalation by the user. For example, the second consumable 2 may produce a flavored aerosol. Additionally or alternatively, one or more properties of the aerosol generated from the first consumable 1 may be modified by material contained by the second consumable 2 and, optionally, by material contained by one or more further consumables 3, 4, 5, etc. received within the device. For example, in some examples, the first consumable 1 produces an aerosol from a tobacco gel 10 while the second consumable 2 and further consumables 3, 4, 5, etc. contain aerosolizable flavorant gels 20, 30, 40, etc. for producing aerosol for mixing with aerosol produced from the first consumable 1. An aerosol flow for inhalation by the user is thereby produced from consumables 1, 2, 3, etc. received within the device 100.

In at least some examples a vapor is produced that then at least partly condenses to form an aerosol before exiting the aerosol provision device for inhalation by a user.

In this respect, first it may be noted that, in general, a vapor is a substance in the gas phase at a temperature lower than its critical temperature, which means that for example the vapor can be condensed to a liquid by increasing its pressure without reducing the temperature. On the other hand, in general, an aerosol is a colloid of fine solid particles or liquid droplets, in air or another gas. A "colloid" is a substance in which microscopically dispersed insoluble particles are suspended throughout another substance.

For reasons of convenience, as used herein the term aerosol should be taken as meaning an aerosol, a vapor or a combination of an aerosol and vapor.

The first aerosolizable material 10 can be a gel that is volatilizable at reasonable temperatures, as that helps to keep down the power consumption of the aerosol provision device 100.

In the examples described herein, the first aerosolizable material 10 may be a nicotine-containing material and may be, for example, a tobacco containing material. In some examples the first aerosolizable material 10 is a tobacco material, and in some embodiments the first aerosolizable material 10 is an aerosolizable tobacco gel.

The second material 20 may be a second aerosolizable material and may be a flavorant material. The second material 20 may be a gel, a liquid, a powder, or another form of aerosolizable substance. In some examples, the second material 20 is a first aerosolizable flavorant material. In such examples the second material 20 can be a first flavorant gel, referred to in some instances herein as a base flavorant gel 20.

While in the examples discussed herein the materials 10, 20, 30, etc. are liquids or gels, it should be appreciated that the first material 10 may be any material capable of being aerosolized while the remainder of the materials 20, 30, 40, etc. may be materials which may or may not be capable of being aerosolized or could be any form of material suitable for modifying the properties of an aerosol flow. For example, the further materials 20, 30, etc. may or may not be aerosolizable and may be a liquid, a gel, or a powder and may comprise a solid material, such as a tobacco material.

One or more of the further materials 20, 30, 40, etc. may be a material which imparts to or modifies a property, for example the flavor, of the vapor and/or aerosol before the vapor and/or aerosol passes out of the device 100 for inhalation by a user. One or more of the further materials 20, 30, 40, etc. may, for example, consist of or comprise tobacco. In the case that one or more of the further materials 20, 30, 40, etc. comprises tobacco, as the aerosol passes through and over the material/s, the aerosol entrains organic and other compounds or constituents from the tobacco material that lend tobacco its organoleptic properties, thus imparting flavor to the aerosol.

In some examples, the further material 20, 30, 40, etc. may comprise a material that modifies one or more other organoleptic properties of the aerosol (e.g. modifying the feel or smell or look of the aerosol to the user).

In some examples, the further material 20, 30, 40, etc. may comprise a material that modifies the PH of the aerosol by either lowering or raising the PH (e.g. modifying the acidity or the basicity of the aerosol).

In some examples, the further material 20, 30, 40, etc. may comprise a material that modifies (e.g. reduce) the amount of aldehydes in the aerosol.

In some examples, the further material 20, 30, 40, etc. may comprise a material that modifies different combinations of two or more of these or indeed other properties of the aerosol.

In some examples, the further consumables 2, 3, 4, etc. comprise flavourant materials, for example solid material, that which when ground, exposed, or otherwise suitably physically activated, releases a flavorant. The flavorant material may be, for example, ground tobacco. The flavorant material may be for example wrapped partially or wholly in a wrapper, and/or the flavorant material may be supported in a resilient housing, for example a plastic housing, or may be held or embedded in a suitable carrier material such as cellulose acetate. When a consumable is actuated, the solid material is exposed or otherwise suitably physically activated, and a flavorant (or an increase and/or change in flavorant) is released thereby to impart a flavor (or increased and/or different flavor) to the aerosol flow.

Each consumable 1, 2, 3, etc. may be a pod, a cartridge, a tube, a capsule, or another type of container for containing a material 10, 20, 30, etc. In example consumables which contain an aerosolizable material, each consumable 1, 2, 3, etc. may contain means for aerosolizing material in the consumable. The means for aerosolizing the material in the consumable may comprise heating means. For example, the material may be aerosolized by resistive heating or induction heating. Each consumable may comprise an atomizer. The atomizer may comprise heating means, such as at least one heating element, for aerosolizing the material contained in the consumable. The at least one heating element may be a resistive heating coil and may be a linear coil, a curved coil, a bottom vertical coil, or a spiral coil. In alternative examples, a heating means may not be used and an alternative arrangement may be used for aerosolizing the material, such as an ultrasonic atomizer.

Now with reference to FIG. 2, the device 100 may comprise a device body 300 which contains a power source 320, typically a battery, for powering various components of the device 100. The battery 320 may be a rechargeable battery or a disposable battery. A controller 330, which may comprise a micro-chip and associated circuitry is also provided in the device body 300 for controlling the operation of various components of the device 100. The device 100 comprises a communication interface 350 which may be located in the device body 300 for communicating with the communication system 250, for example for communicating with the smart device 200. A user input means 340, for example one or more control buttons, such as an on/off switch or button, may be provided on the device body 300 for a user to operate the device 100.

In some examples, such as the example shown in FIG. 2, the device 100 comprises a plurality of slots 101, 102, 103, etc. for receiving consumables 1, 2, 3, etc. The first slot 101 may be configured to receive either of the first consumable 1 or the second consumable 2 (or any of the further consumables 3, 4, 5, etc., not all of which are shown in FIG. 2).

In some examples, the device 100 comprises third 103, fourth 104, fifth 105, and sixth 106 slots for receiving further consumables. In some examples, any of the slots 101, 102, 103, etc. may be configured to receive any one of the consumables 1, 2, 3, etc.

The aerosol provision device 100 is capable of recognizing the identity of a consumable 1, 2, 3, etc. which is received by the device 100 and for recognizing the position in the device 100 in which the recognized consumable is received. For example, in the example of FIG. 2, if, for example, a consumable 1, is inserted into the first slot 101, the device 100 recognizes the identity of the consumable as the first consumable 1 and recognizes that the first consumable 1 is inserted into the first slot 101, and if, to continue the example, a second consumable 2 is inserted into the second slot 102, and a third consumable 3 is inserted into the third slot 103, the device 100, similarly, recognizes this.

In some examples, each consumable is recognizable by the device 100 by radio-frequency identification (RFID). In the example of FIG. 2, each consumable 1, 2, 3 comprises an RFID tag 41, 42, 43 and each slot of the device 100 comprises an RFID reader 41, 42, 43. The device 100 may comprise means (not shown) for supplying power from the power source 320 to the at least one RFID reader 41, 42, 43. In other examples, the device 100 may comprise a different number of RFID readers, for example one RFID reader which is capable of reading an RFID tag of any consumable 1, 2, 3, etc. received within the device 100 and identifying the position of that consumable. When a consumable is inserted into a slot the RFID tag is read by the device 100 and the consumable is thereby identified.

In some examples (not shown in the figures), the aerosol provision device 100 may not comprise individual slots for receiving each consumable and, for example, all consumables received by the device 100 may be received in a single slot. In such examples, the position or each consumable and identity of each consumable may be identified by an RFID reader, or by other means: for example, the consumables may comprise electrical contacts such that their ordering can be determined by the device, for example by the electrical resistance presented by the combination of inserted consumables.

Each consumable may comprise an actuation means (not shown) for causing the material to exit the consumable. The actuation means may be formed partly or wholly in the consumable; for example, in some implementations, the component for actuating is located in the device but engages with a part of the consumable (such as a wall of the consumable). The specific manner in which the consumables may be actuated is not the focus of this disclosure, and any suitable mechanism may be employed. Moreover, this may be applicable in situations in which the heater (or other atomizing mechanism) is located outside the consumable and the aerosolizable material is directed towards the heater in order to be aerosolized. In some examples where a consumable contains a viscous aeroslizable material, such as an e-liquid, the actuation means may be a spring mechanism (not shown) which applies a force during a usage session either directly to the material 10, 20, 30, etc. or to the consumable. When a force is applied to the consumable, for example via a biasing mechanism, such as a spring mechanism, a reservoir containing the material is squeezed (deformed) and the material is thereby forced from the reservoir through the aperture to be aerosolized. In such examples, the force applied may determine the rate at which the material is released to the aerosol flow. This force may be controlled by electronic means controlling a biasing force applied against the spring mechanism. The force may be applied mechanically or electronically and may be controlled electronically via the control mechanism 140 of the aerosol provision device 100.

In some examples one or more of the consumables 1, 2, 3, etc. does not comprise means for aerosolizing a material 10, 20, 30, etc. In the example of a consumable which does not comprise aerosolizing means but wherein the consumable comprises aerosolizable material, the material may be aerosolized by the device 100 by an aerosolizing means (not shown) after the material exits the consumable. For example, the device 100 may comprise heating means for aerosolizing material that has exited a consumable into the device.

Returning to the example of FIG. 2, first consumable 1, second consumable 2 and third consumable 3 are received in the device 100 for use. The first consumable 1 comprises a first aerosolizable material 10, the second consumable 2 comprises an aerosolizable base flavorant material 20, and a third consumable 3 comprises a first additional flavorant material 30. The device 100 may comprise means for controlling the rate at which the material in each consumable 1, 2, 3, is aerosolized. For example, the controller 330 may control the rate at which a consumable received in the device is actuated during a usage session. The controller 330 may control any number of aspects of the usage of the device 100 including one or more of: the duration of a usage session, a selection of which consumables received within the device 100 are actuated during a usage session, the rate at which each consumable is used during each point of a usage session, the order in which consumables are used during the session, and the duration for which a consumable is used during the session.

The device 100 comprises means, communication interface 350, for communicating with a smart device 200. The smart device 200 may be, for example, a mobile phone or a tablet computer, and the device 100 may communicate with the smart device 200 wirelessly, for example via WiFi™, Bluetooth™ technology, or GSM. Alternatively, the device 100 may communicate with the smart device via a wired connection, such as a USB or ethernet connection.

Accordingly, in use, a user inserts one at least a first consumable 1 into one of the slots 101-106. The device 100 reads the RFID identifying tag 31 on the first consumable 1 via the first RFID reader 151. The RFID identifying tag 31 may carry information indicating the type of material contained by the consumable, for example it may indicate that the consumable contains a tobacco gel. In examples where the consumable comprises a sensor (not shown) for detecting the remaining amount of material contained by the consumable, the RFID tag 31 may also carry this information for reading by the RFID reader 151.

The aerosol provision device 100 is configured by the user to communicate with the smart device 200, for example by the user 'pairing' the aerosol provision device 100 and the smart device 200 via Bluetooth™. The aerosol provision device 100 transmits data to the smart device 200 indicating that a consumable 1, 2, 3, etc. is inserted into a slot 101, 102, 103, etc. of the device 100. The smart device 200 gathers the data and may display to the user a representation (an example of which is described further below) of the current configuration of the aerosol provision device 100, showing the identity of inserted consumables and their positions within the device.

Figure 3:
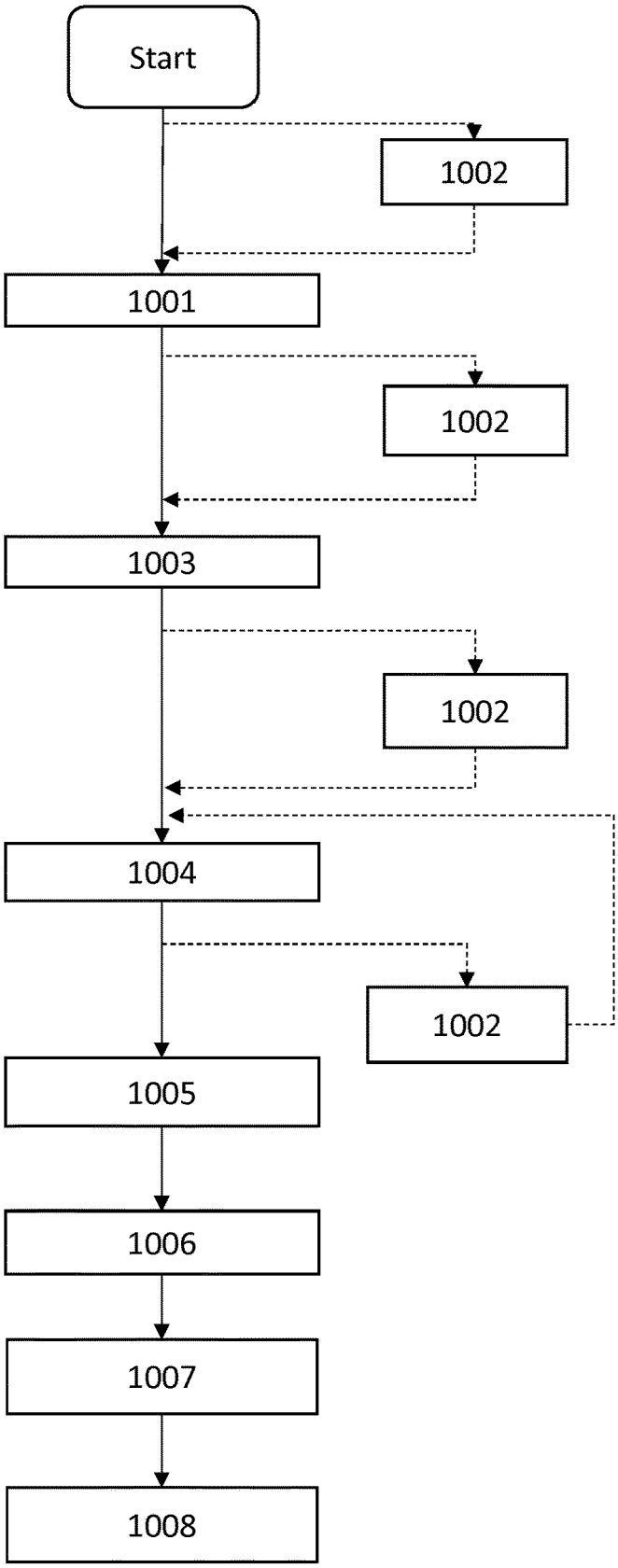
FIG. 3 shows a schematic flowchart representation of an example method of use of the aerosol provision device and communication system of FIG. 1 and the aerosol provision device of FIG. 2.

FIG. 3 shows a flow diagram demonstrating an example of the method of use of the aerosol provision device 100 and the smart device 200. In this example, the smart device 200 is configured to control the aerosol provision device 100.

In the example of FIG. 3, at 1001 the user turns on the aerosol provision device via user control means 340. At 1002 the user inserts one or more consumables 1, 2, 3, etc. into one or more slots 101, 102, 103, etc. in the aerosol provision device 100; it should be noted that at 1002 the inserting consumables may be performed before 1001 or at any point in the method, for example after pairing the aerosol provision device 100 with the smart device 200. At 1003 the user pairs the aerosol provision device 100 with the smart device 200, for example via Bluetooth™ technology. At 1004 the aerosol provision device 100 recognizes at least the identity of consumables 1, 2, 3, etc. which are inserted in the device and the slot 101, 102, 103, etc. and in which each consumable 1, 2, 3, etc. is inserted. At 1005 the device 100 communicates data indicating the identity and position of consumables identified at 1004 to the smart device 200. At 1006 the smart device 200 displays a representation (800, FIG. 4) of the aerosol provision device 100 to the user, and displays at least one pre-defined usage session which is available dependent on the consumables which are inserted. Herein the pre-defined usage sessions may be referred to as instructions; in other words, each pre-defined usage session is a set of instructions received, e.g., from a remote server, for controlling the aerosol provision device based on the identity and position of the consumables. For example, the smart device 200 may be configured to obtain pre-defined usage sessions from a remote source or database (e.g., via the internet) based upon the combination of consumables present in the device 100. By way of example only, the usage sessions may include a session such as: aerosolize consumable 1, followed by consumable 2, followed by consumable 3 (e.g., sequential aerosolization) or aerosolize consumable 1 and 3, followed by consumable 2 (e.g., because consumable 1 and 3 may complement each other). Alternatively, the pre-defined usage sessions may include different aerosolization amounts for the different consumables, e.g., aerosolize consumables 1 and 2 such that the generated aerosol is approximately 25% from consumable 1 and 75% from consumable 2 (which may be based on the rate at which the aerosolizable material is fed to the heater and/or the power supplied to the heater). At 1007 the user gives an input to the smart device 200 indicating the pre-defined usage session they would like to implement. At 1008 the smart device communicates the user's input to the aerosol provision deice 100 and the usage session is implemented by the control means 340.

It should be appreciated that while the method described by FIG. 3 involves pairing (or otherwise communicatively connecting) the aerosol provision device 100 and the smart device 200, the aerosol provision device 100 may, in other implementations, be provided with the ability to contact a remote source, e.g., a remote sever, independently of the smart device 200. That is, in the above method, the smart device 200 may be omitted and the aerosol provision device 100 is instead provided with the ability to perform the functions of the smart device 200.

Figure 4:
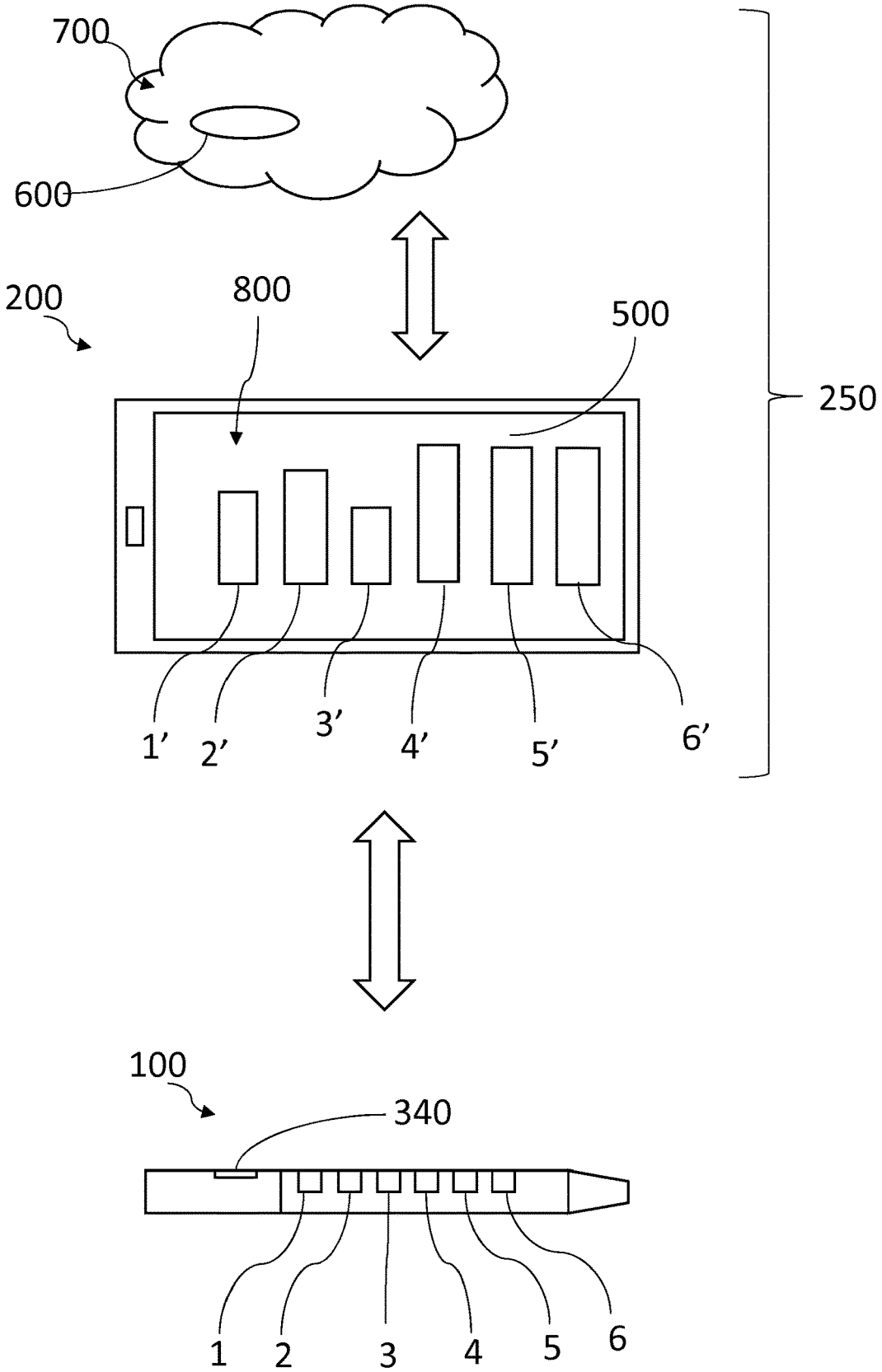
FIG. 4 shows a schematic representation of an aerosol provision device in communication with a communication system comprising a smart device running an app in connection with the internet.

With reference to FIG. 4, in some examples, the smart device 200 comprises an app 500 for displaying the configuration of the aerosol provision device 100 to the user. In some examples, such as the example of FIG. 4, the app 500 displays a visual representation 800 of the aerosol provision device 100 to the user, showing which of the slots 101-106 is/are occupied by a consumable 1, 2, 3, etc. and the identity of any inserted consumable. The visual representation 800 may comprise a list of available slots and occupied slots, or may be a pictorial representation of the aerosol provision device 100. For example, in the example of FIG. 4 six consumables 1-6 are inserted into the device 100. The visual representation 800 shows a representation 1', 2', 3' etc. of each consumable 1, 2, 3 and may display, for example, the material 10, 20, 30, etc. which is contained by each consumable 1, 2, 3, etc. and the remaining amount of material in each consumable, for example representing this by bars of varying heights. In the example of FIG. 4, the app 500 may display representations 1' to 6' indicating to the user that the first consumable 1 contains a tobacco gel 10, the second consumable 2 contains a menthol flavorant 20, the third consumable 3 contains a cherry flavorant 30, and so on with regards to the fourth 4, fifth 5 and sixth 6 consumables. The user may then in some examples select which flavorants they would like to use and at which relative rates through use of the app 500, for example by tapping on a representation 1', 2', 3', etc. of a consumable and setting various parameters.

The data regarding the position and identity of consumables received in the device 100 can be used to make a recommendation of a usage session for the user. For example, if the device 100 detects the insertion of a tobacco gel 10 containing first consumable 1 into the second slot 102 and the insertion of a base flavor 20, e.g. a menthol flavor, containing base flavor consumable 2 into the first slot 101, the device 100 can make a recommendation of a usage session comprising the use of tobacco gel and menthol flavorant. A usage session may be defined by various factors, such as which of any inserted consumables is actuated during the session, the duration for which a consumable is actuated during the session, the rate at which a consumable is actuated to provide the material it contains for being aerosolized, and the point during the session at which a particular consumable is used at a particular rate. During a usage session, the user may view the representation of the aerosol provision device 100 via their smart device 200 and thereby obtain information about appropriate parameters for implementing a usage session.

The device 100 may comprise means for transmitting further information in addition to the identity and position of an inserted consumable. For example, the device 100 may communicate the amount of material remaining in a consumable 1, 2, 3, etc. to the smart device 200. The device 100 may obtain the information on the amount of material remaining in the consumable from the consumable itself, which may in some examples comprise a sensor (not shown) and the information obtained by the sensor may be communicable via the RFID tag. As such, in such examples the smart device 200 can, for example, compute a recommended duration for a usage session, or display a predicted number of remaining sessions having a particular duration and using a particular combination of consumables at a particular rate, for example based on data previously received about the prior usage of the user. The device 100 may also comprise means for transmitting further information relating to a usage session, such as the duration for which a consumable was actuated during the session, the rate at which a consumable was actuated to provide the material it contains for being aerosolized, and the point during the session at which a particular consumable was used at a particular rate.

The manual user control means 340 may comprise a switch for turning on or off the device 100 and/or the manual user control means 340 may allow the user to pair the aerosol provision device 100 with the smart device. In some examples, the user may control various parameters of the usage of the device via the manual user control means 340 i.e. the user may manually control the device 100 rather than control the aerosol provision device 100 through the smart device 200. The manual user control means 340 may comprise controls for selecting which of the slots 101-106 are to be actuated during a usage session and the user may, for example, select which slot is actuated at a particular point in a usage session. In this regard, in accordance with the present disclosure, the aerosol provision device 100 can be configured to map certain pre-defined usage sessions to the manual user control means 340 based on the identity and/or position of the consumables within the device. For example, the manual user control means 340 may comprise a touch screen display which is configured to display a plurality of pre-defined usage sessions based on the identity and position of the consumables within the device, e.g., such as those described at 1006. In other examples, the representation by the smart device 200 of the consumables inserted into the device 100 can allow the user to implement a desired or appropriate usage session through user control means 340. For example, allowing the user to select the correct slots to actuate and the correct rate at which to actuate each slot to allow a session to use a particular combination of flavors or last for a desired length of time.

In some examples, the smart device 200 is configured to control the aerosol provision device 100, such as via wireless communication. For example, the smart device 200 may be configured to switch on the aerosol provision device 100 to initiate a usage session. In at least some examples, the smart device 200 may be configured to control factors defining a usage session of the aerosol provision device 100, such as selecting which consumable is actuated at a particular point in a usage session, and/or the respective rates at which each consumable is actuated at each point during the usage session. In examples where the smart device 200 is configured to control parameters of the aerosol provision device 100, the aerosol provision device 100 may still comprise user control means 340 such as an on/off switch for initiating the device or a button to pair the aerosol provision device 100 with the smart device 200.

In examples where the smart device 200 comprises an app 500, the app 500 may be configured to receive input, for example from a user or via the internet, the app 500 then providing an interface to the user via which the user can control the aerosol provision device 100.

In some examples, the smart device 200 is configured to gather usage data of the aerosol provision device 100 and cause that data to be stored for later use. In such examples, the gathered data for storage may include: the duration of a usage session, the identity of consumables inserted into the device in a usage session, the position of each consumable in the device during a usage session, which of the consumables inserted in the device was actuated during the session, the respective rates at which each consumable was actuated during the usage session, and/or the duration for which each consumable was actuated during the usage session.

The smart device 200 may store the data locally or may communicate the data via the internet to be stored non-locally, for example via one or more cloud-based servers i.e. the data may be stored in 'the cloud'. The smart device 200 may be configured to cause a profile to be made, wherein the profile 600 may be associated with a user and/or with a particular aerosol provision device 100. For example, such that when the user pairs the aerosol provision device 100 with a smart device 200 the smart device 200 recognizes the identity of the aerosol provision device 100 and creates a profile 600 for that device 100. Data from usage sessions of that particular aerosol provision device 100 can then be stored in the device profile associated with that device. In some examples where the profile 600 is stored in the cloud 700, the user may pair the aerosol provision device 100 with a second smart device (not shown) and the second smart device may recognize the identity of the aerosol provision device 100 and access the associated device profile which is stored on the cloud 700.

In some examples, a user profile 600 is created which is associated with a user. The user profile 600 may be stored on the cloud 700, as in the example of FIG. 4, and may store the usage data for the user with whom it is associated. The user then, for example, pairs the aerosol provision device 100 with their smart device 200 and logs into their user profile 600 via the smart device 200, such as via an app 500. The user profile 600 may for example store data related to usage sessions of the aerosol provision device 100.

In examples where the smart device 200 communicates with the aerosol provision device 100 via an app 500, the app 500 may display a number of pre-set usage sessions for implementing by the aerosol provision device 100. In examples where the aerosol provision device 100 comprises user controls 340 for controlling the device 100, the app 500 may simply display the parameters for a usage session which may be based on the consumables currently received in the device 100. For example, the app 500 may display that the first slot 101 currently contains a tobacco gel consumable 1, the second slot 102 currently contains a menthol base flavor consumable 2, and the third slot 103 contains a first additional flavor consumable 3. The app 500 may then display the amount of respective materials contained in each consumable 1, 2, 3, etc. The app 500 may display a recommended usage session in the form of indications of the rate at which each consumable 1, 2, 3, etc. is to be actuated during the session. So, for example, the app 500 may display a recommended usage session 5 minutes in duration in which the first consumable is actuated at a first rate throughout the usage session, the second consumable is actuated at a second rate throughout the session, and the third consumable is actuated at a third rate but is only actuated for the first 30 seconds and for the final 30 seconds of the 5-minute session. In some examples, a user can implement a pre-set or recommended usage session via the smart device 200.

In some examples, the smart device 200 receives data from the aerosol provision device 100 during a usage session and saves this data as a first stored usage session. This first stored usage session may then, for example, be viewed by the user via the app 500 and implemented again at a later time. In some examples where the smart device 200 is configured to control the aerosol provision device 100, the app 500 is configured to implement a usage session which is based on the stored first usage session. As such, the user can save their favorite usage sessions and implement a repeated instance of the session at a later time.

As mentioned above, the app 500 may comprise at least one pre-set usage session, and in some examples a user can implement a pre-set usage session via the app 500. Each pre-set usage session may comprise the use of different types of consumable, actuated at different rates, actuated for different times, or positioned in a particular order within the slots of the device 100. Since the smart device 200 recognizes the identity and position of consumables received in the aerosol provision device 100, the app 500 may display pre-set usage sessions depending on their availability according to which consumables are inserted into the aerosol provision device slots 101-106, and in which order the consumables are inserted. In some examples, the app 500 may instruct a user to change the ordering of consumables within the device slots 101-106 in order to set up the aerosol provision device 100 for a particular pre-defined usage session.

The app 500 may allow a user to create and store a usage session for future implementation. For example, the user may create a usage session in which a particular combination of flavors is to be used, at particular relative rates, and the inserted consumables are positioned and actuated in a particular order. The user may then store this session, for example to be associated with their user profile 600 and stored on the smart device 200 or via the cloud 700, for later implementation. In some examples, the user may be able to share their stored usage sessions with other users via, for example, social media.

In some examples, the app 500 may allow a user to place an order via the internet for consumables for the aerosol provision device 100. The app 500 may allow a user to place an order via the internet for consumables used in a prior recorded usage session or to be used in a usage session created by the user on the app 500.

The app 500 may make a recommendation to the user for a usage session, wherein the recommended usage session uses a particular combination of consumables in a particular way. For example, the recommendation of a usage session may be made based on prior usage sessions of that user, or may be made with reference to other information about the user associated with the user profile 600. A recommendation for a usage session may contain additional information as to the context in which that usage session is recommended to implemented—for example, a usage session may be recommended as appropriate for use of the aerosol provision device 100 indoors or outdoors, or for pairing with a particular food and/or drink. For example, the app 500 may provide a recommendation of a usage session for pairing with wine.

In some examples, the app 500 may gather contextual information via the smart device 200, and may infer, for example, whether the user is indoors or outdoors or may detect the location of the smart device 200 and/or aerosol provision device 100. The smart device 200 may then be configured to control the aerosol provision device 100 based on this gathered contextual information. For example, the smart device 200 may be configured to set the aerosol provision device 100 to indoor mode when the smart device 200 infers that the user is indoors. In examples where the smart device 200 is not configured to make use of contextual information, the app 500 may provide the user with the option to control usage settings of the aerosol provision device 100 and, for example, switch the device 100 to an 'indoor mode'.

Usage settings may be configured to have particular characteristics, for example an indoor usage mode may be configured to produce less vapor, or to produce a vapor which is more suitable for an indoor context, having a particular level of aroma or a particular level of nicotine content, for example.

The app 500 may be configured to provide feedback to the user related to the usage of the aerosol provision device 100 or consumables inserted into the device 100. For example, the smart device 200 could provide audio or haptic feedback, by playing a tone or vibrating for example, when it is detected that a consumable is low on material. The app 500 could provide a notification to the user when a new session has been saved and/or could provide a notification to the user when a new usage session is available for implementation, for example, where a usage session has been shared by another user.

FIGS. 5*a*-5*c* and FIGS. 6*a*-6*c* show examples of usage sessions which may be implemented by the aerosol provision device 100, in some examples these example usage sessions may be implemented by the app 500. Each representation of a usage session shown in FIGS. 5*a*-5*c* and FIGS. 6*a*-6*c* shows a representation of the amount of material from each consumable used produce the aerosol at each point in the usage session. In these figures the time elapsed in each usage session is represented from left to right so that the left of each figure represents the start of a usage session while the right represents the end of a usage session. The height of a representation of each consumable represents a factor related to the usage of that consumable at a particular time in the usage session.

Figure 5A:
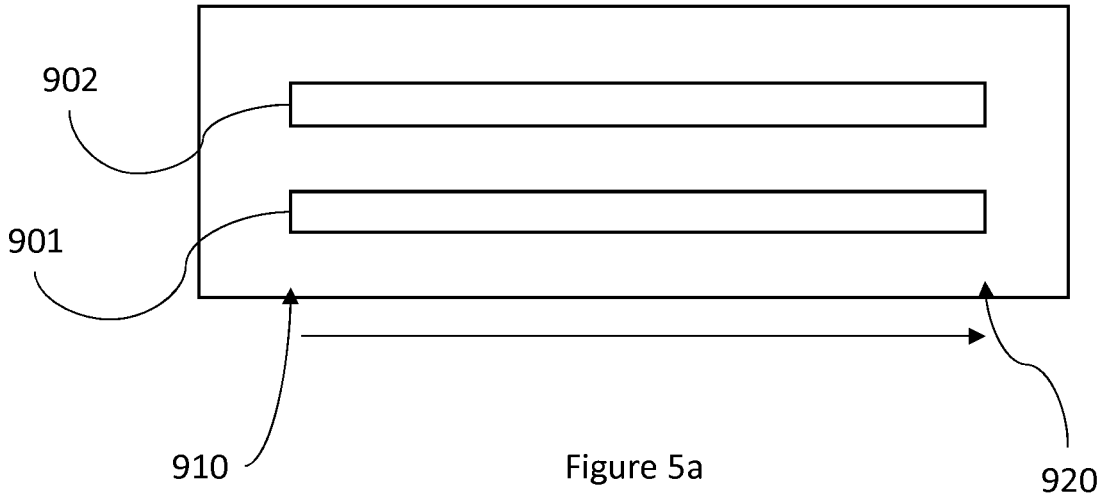
FIGS. 5*a* to 5*c* show schematic representations of example usage sessions of the aerosol provision device with two consumables being received by the device.
Figure 5B:
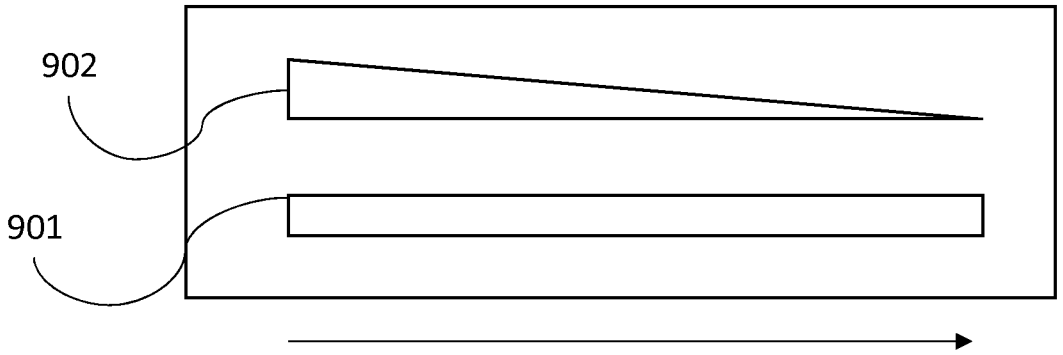
Figure 5C:
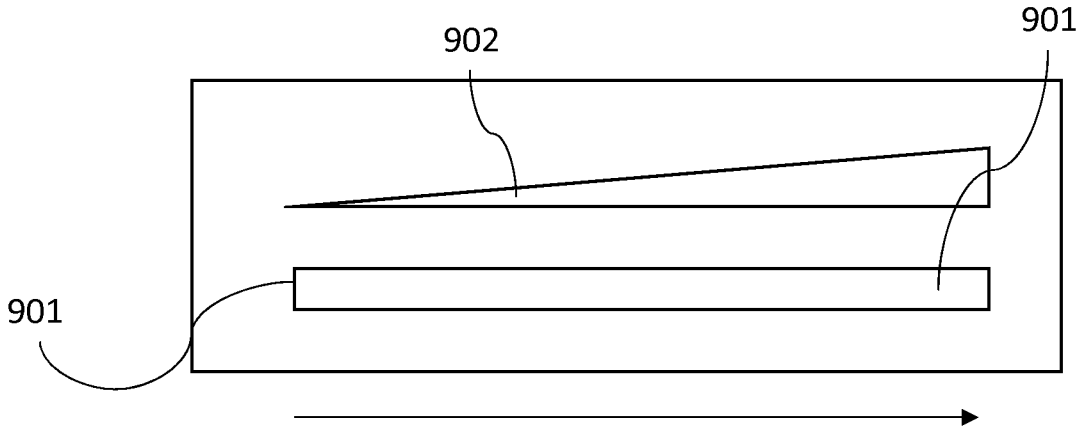

In FIGS. 5*a*-5*c*, a first bar 901 represents use of the first consumable 1, containing a tobacco gel 10, in the example usage session. The height of the first bar 901 represents the rate that the tobacco gel 10 is aerosolized at the point in time in the session to which that height corresponds, with time progressing from the start of the session 910 to the end of the session 920. A second bar 902 represents use of second consumable 2 containing a base flavorant material 20, in these examples a menthol flavorant. The height of the second bar 902 represents the rate at which the menthol flavorant 20 is aerosolized throughout the usage session. It should be appreciated that relative heights of the first bar 901 and second bar 902 in the figures do not represent an absolute relation between values of the rates of aerosolization of each of the materials, for example, bars of equal height may not represent equal rates of aerosolization for each material 10, 20.

FIG. 5*a* shows a first example usage session wherein the tobacco gel 10 is aerosolized at a first constant rate throughout the usage session and the menthol base flavorant 20 is aerosolized at a second constant rate throughout the usage session. In this example, the menthol base flavorant 20 is aerosolized at a rate which is 0.25 times the rate at which the tobacco gel 10 is aerosolized, but in other examples the first rate and the second rate may have any other ratio for example the first rate may equal the second rate.

FIG. 5*b* shows a second example usage session where the rate of menthol flavorant 20 use is greatest at the start of the usage session and the rate of menthol flavorant 20 reduces at a constant rate throughout the usage session. The tobacco gel 10 is aerosolized at a constant rate in this example.

FIG. 5*c* shows a third example usage session wherein the rate of menthol flavorant 20 increases from a minimum value at the start of the session 910 to a maximum value at the end of the session 920. The tobacco gel 10 is, again, aerosolized at a constant rate in this example.

Figure 6A:
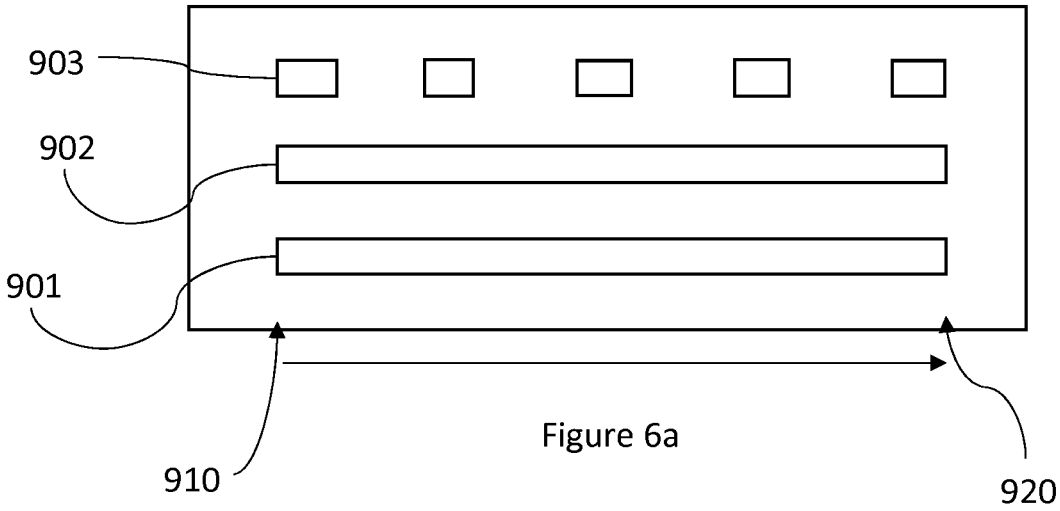
FIGS. 6*a* to 6*c* show schematic representations of example usage sessions of the aerosol provision device with three consumables being received by the device.
Figure 6B:
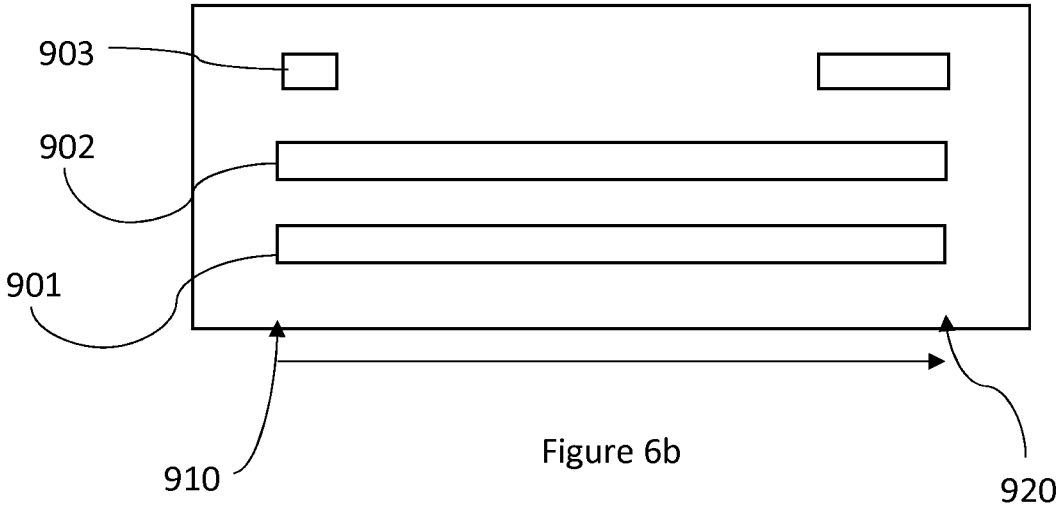
Figure 6C:
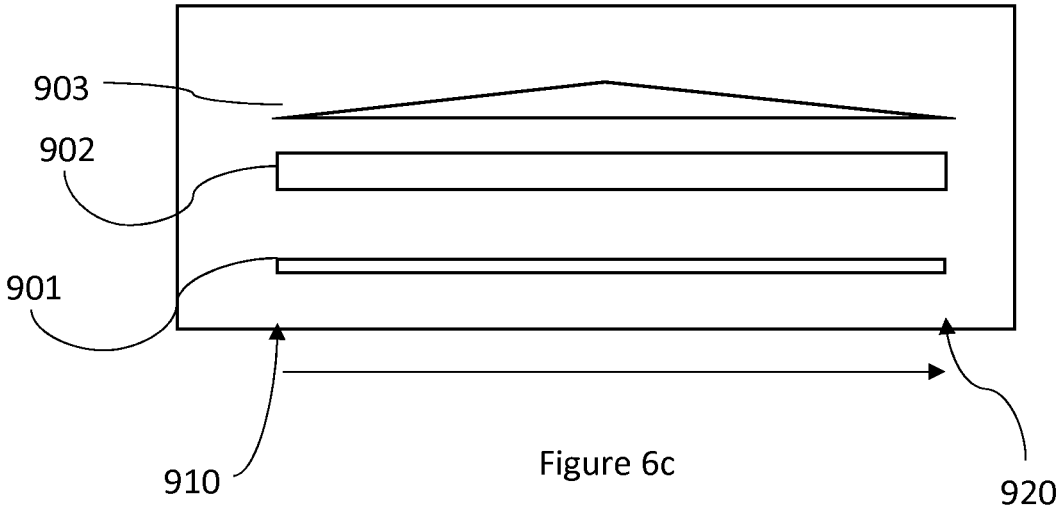

FIGS. 6*a*-6*c* show examples of usage sessions in which a third consumable 3 is inserted into the aerosol provision device 100, in addition to the first 1 and second 2 consumables. In these examples the third consumable 3 contains a first additional flavorant material 30 which is an aerosolizable material. The rate of aerosolization of the first additional flavourant material 30 is represented by the height of a third bar 903.

FIG. 6*a* shows an example usage session wherein the tobacco material 10 and the base flavorant 20 are aerosolized at a constant rate throughout the usage session. The first additional flavorant 30, represented by third bars 903, is periodically aerosolized at a constant rate for a first period of time and aerosolized at a rate of zero for a second period of time. This pattern of aerosolization of the first additional flavorant 30 is repeated throughout the usage session.

FIG. 6*b* shows an example usage session wherein the tobacco material 10 and the base flavorant 20 are aerosolized at a constant rate throughout the usage session. The first additional flavorant 30 is aerosolized at a constant rate for a first period of time at the start of the session 910 and is aerosolized at a constant rate for a second period of time directly before the end of the session 920.

FIG. 6*c* shows an example usage session in which the tobacco gel 10 is aerosolized at a constant rate which is lower than in previous examples, this may, for example, correspond to an indoor mode for the aerosol provision device 100 in which it is desirable or necessary to reduce the amount of nicotine contained in aerosol produced by the device 100. The menthol flavorant material 20 is aerosolized at a constant rate throughout the usage session. The first additional flavorant increases at a constant rate from a minimum value at the start of the session 910 to a maximum value at some point, for example the mid-point in time, of the session. The rate of aerosolization of the third flavorant 30 then reduces at a constant rate until the end of the session 920.

Although in the above described examples, the aerosol provision device 100 etc. generates the aerosol by heating a gel, this is not essential and in other examples, the device may generate the aerosol by heating a liquid or by heating, but not burning (combusting), a material, for example comprising a solid material, that may contain for example tobacco (e.g. a device sometimes referred to as a Tobacco Heating Product (THP) device).

Although in the above described examples, each consumable is provided with an identifier (e.g., an RFID tag), it should be appreciated that when the aerosolizable materials are provided on/in the same substrate, only one identifier may be present. The substrate may be provided with an identifier (e.g., an RFID tag, a QR code, etc.) which can be read (by the device 100 or the smart device 200) to identify the consumable and the positions of the aerosolizable portions on the consumable.

As used herein, the terms "flavor" and "flavorant" may refer to materials which, where local regulations permit, may be used to create a desired taste or aroma in a product for adult consumers. They may include extracts (e.g., licorice, *hydrangea*, Japanese white bark *magnolia* leaf, chamomile, fenugreek, clove, menthol, Japanese mint, aniseed, cinnamon, herb, wintergreen, cherry, berry, peach, apple, Drambuie™, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, *cassia*, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, solid, or powder. For example, a liquid, oil, or other such fluid flavorant may be impregnated in a porous solid material so as to impart flavor and/or other properties to that porous solid material. As such, the liquid or oil is a constituent of the material in which it is impregnated.

The above embodiments are to be understood as illustrative examples of the invention. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. An aerosol provision device configured to receive a plurality of aerosolizable materials, wherein the aerosol provision device is configured to recognize an identity and a position of the plurality of aerosolizable materials received in the aerosol provision device and transmit data indicating the identity and the position of the aerosolizable materials received in the aerosol provision device to a communication system, wherein the communication system is separate from the aerosol provision device.

2. The aerosol provision device according to claim 1, wherein the aerosolizable material is a material for producing an aerosol or altering a property of an aerosol.

3. The aerosol provision device according to claim 1, wherein the communication system comprises a smart device.

4. The aerosol provision device according to claim 3, wherein the communication system comprises at least one internet-based server and wherein the smart device is configured to communicate data transmitted from the aerosol provision device to the internet-based server.

5. The aerosol provision device according to claim 1, wherein the communication system is configured to display to a user a representation of a configuration of the aerosol provision device, wherein the representation comprises a representation of the identity and the position of each of the plurality of aerosolizable materials received in the aerosol provision device.

6. The aerosol provision device according to claim 1, wherein the communication system is configured to display to a user a representation of a current or a completed usage session of the aerosol provision device.

7. The aerosol provision device according to claim 1, wherein the communication system is configured to gather one or more types of data relating to usage of the aerosol provision device in addition to the identity and the position of the plurality of aerosolizable materials received in the aerosol provision device, wherein the one or more types of data relate to one or more of: a duration of a usage session, the identity of each of the plurality of aerosolizable materials used during a usage session, an amount of each of the plurality of aerosolizable material used during a usage session, a rate at which each of the plurality of aerosolizable materials is used during a usage session, an amount of each of the plurality of aerosolizable materials remaining after a usage session, or an order in which the plurality of aerosolizable materials were used during a usage session.

8. The aerosol provision device according to claim 1, wherein the communication system is configured to provide a pre-defined usage session to a user, wherein the pre-defined usage session is at least in part defined by one or more of: a duration of a usage session, the identity of each of the plurality of aerosolizable materials used during a usage session, an amount of each of the plurality of aerosolizable materials used during a usage session, a rate at which each of the plurality of aerosolizable materials is used during a usage session, an amount of each of the plurality of aerosolizable materials remaining after a usage session, or an order in which the plurality of aerosolizable materials were used during a usage session.

9. The aerosol provision device according to claim 8, wherein the pre-defined usage session is a recommended usage session or a past usage session of the user for which defining data has been gathered by the communication system from the aerosol provision device.

10. The aerosol provision device according to claim 8, wherein a factor defining a pre-defined usage session which is provided to the user is dependent on the identity of plurality of aerosolizable materials recognized as being received in the aerosol provision device at a time that the pre-defined usage session is provided to the user.

11. The aerosol provision device according to claim 8, wherein a factor defining a usage session which is provided to the user is dependent on information gathered by the communication system in addition to the identity and the position of the plurality of aerosolizable materials received in the aerosol provision device.

12. The aerosol provision device according to claim 1, wherein a user may create a usage session via the communication system, wherein the usage session is defined by one or more of: a duration of the usage session, the identity of each of the plurality of aerosolizable materials used during the usage session, an amount of each of the plurality of aerosolizable materials used during the usage session, a rate at which each of the plurality of aerosolizable materials is used during the usage session, an amount of each material remaining after the usage session, or an order in which the plurality of aerosolizable materials are used during the usage session.

13. The aerosol provision device according to claim 1, wherein the communication system is configured to control the aerosol provision device.

14. The aerosol provision device according to claim 13, wherein the communication system is configured to implement a user created usage session or a pre-defined usage session.

15. The aerosol provision device according to claim 1, wherein the aerosol provision device is configured to receive a first aerosolizable material, a second aerosolizable material, and at least one further aerosolizable material, wherein the first aerosolizable material comprises an aerosolizable material and the second aerosolizable material comprises a first flavorant material, and the at least one further aerosolizable material comprises a second flavorant material.

16. The aerosol provision device according to claim 1, wherein the aerosol provision device comprises a plurality of slots and each of the plurality of slots is for receiving one aerosolizable material.

17. The aerosol provision device according to claim 1, wherein each of the plurality of aerosolizable materials is provided in a container, and wherein each container comprises an RFID tag and the aerosol provision device comprises at least one RFID tag reader.

18. The aerosol provision device according to claim 1, wherein each of the plurality of aerosolizable materials is provided in a container, and wherein at least one of the containers comprises an atomizer for aerosolizing material contained by the container.

19. The aerosol provision device according to claim 1, wherein the aerosol provision device comprises means for aerosolizing the plurality of aerosolizable materials.

20. A system comprising the aerosol provision device according to claim 1 and the communication system.

21. A method of use of the system according to claim 20, wherein the method comprises the aerosol provision device transmitting data indicating the identity and the position of the plurality of aerosolizable materials received within the aerosol provision device to the communication system.

22. A smart device configured to communicate with the aerosol provision device according to claim 1, wherein the aerosol provision device is configured to transmit the identity and the position in the aerosol provision device of the plurality of aerosolizable materials received in the aerosol provision device to the smart device, wherein the smart device is separate from the aerosol provision device.

23. A set of instructions for a communication system, wherein the set of instructions comprises receiving data from the aerosol provision device according to claim 1, and wherein the data indicates the identity and the position of the plurality of aerosolizable materials received in the aerosol provision device.

* * * * *